United States Patent [19]

Yamada

[11] 4,248,119

[45] Feb. 3, 1981

[54] ELECTRONIC MUSICAL INSTRUMENT PROVIDING CHORD TONES IN JUST INTONATION

[75] Inventor: Shigeru Yamada, Hamamatsu, Japan

[73] Assignee: Nippon Gakki Seizo Kabushiki Kaisha, Hamamatsu, Japan

[21] Appl. No.: 92,984

[22] Filed: Nov. 9, 1979

[30] Foreign Application Priority Data

Nov. 13, 1978 [JP] Japan ..... 53/140294

[51] Int. Cl.[3] ..... G10H 1/38; G10H 5/00

[52] U.S. Cl. ..... 84/1.01; 84/1.03; 84/DIG. 22

[58] Field of Search ..... 84/1.01, 1.03, 1.17, 84/1.24, DIG. 22

[56] References Cited

U.S. PATENT DOCUMENTS

| | | | |
|---|---|---|---|
| 3,809,786 | 5/1974 | Deutsch | 84/1.01 |
| 3,882,751 | 5/1975 | Tomisawa et al. | 84/1.01 |
| 4,114,495 | 9/1978 | Tomisawa | 84/1.01 |
| 4,148,017 | 4/1979 | Tomisawa | 84/1.01 X |
| 4,216,692 | 8/1980 | Okuyama et al. | 84/1.01 |

*Primary Examiner*—S. J. Witkowski

*Attorney, Agent, or Firm*—Spensley, Horn, Jubas & Lubitz

[57] ABSTRACT

An electronic musical instrument of a digital processing type comprises a first ROM storing frequency information corresponding to respective notes for producing tones with pitches of the equally tempered scale, a second ROM storing correction data for the frequency information to shift the pitch to bring to just intonation relationship, a chord detector for identifying the root note, and a pitch adjusting circuit for modifying the frequency information of the chord constituent notes other than the root note in accordance with the correction data read out from the second ROM.

Thus the tones are produced in just intonation relationship when they constitute a chord and otherwise in a normal equally tempered scale.

7 Claims, 6 Drawing Figures

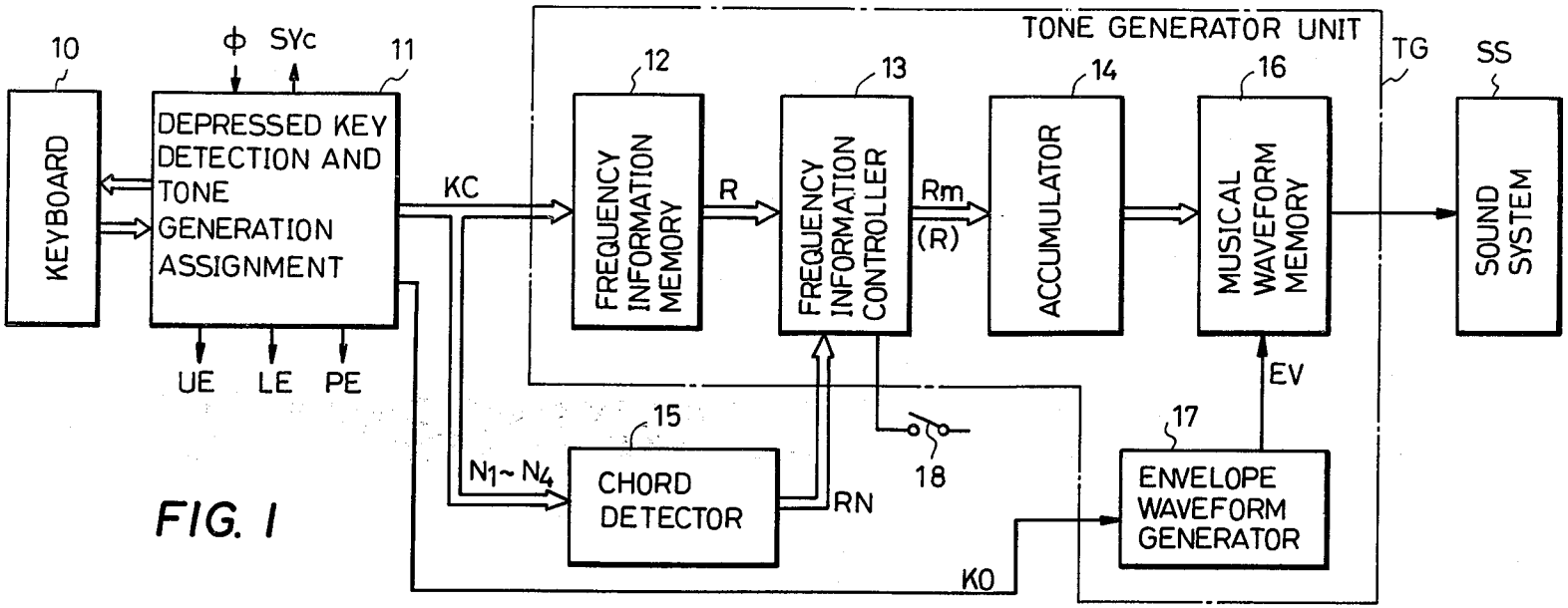
FIG. 1
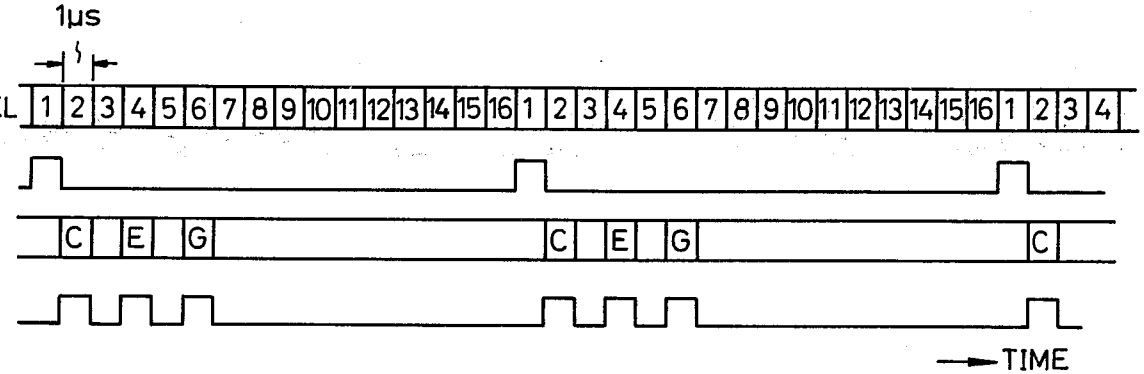
FIG. 2A
FIG. 2B
FIG. 2C
FIG. 2D

ELECTRONIC MUSICAL INSTRUMENT PROVIDING CHORD TONES IN JUST INTONATION

BACKGROUND OF THE INVENTION

This invention relates to an electronic musical instrument capable of producing chord tones in consonant note intervals.

Generally, an electronic musical instrument is tuned in an equally tempered scale so that it is easy to modulate or transpose to other keys or to make ensemble performance with other musical instruments. However, when the electronic musical instrument is thus tuned with the equally tempered scale, such chord tones as major triad chord tones are not produced in perfect consonant intervals so that it constitutes one of the factors that disturb harmony. For example, when major triad chord tones are produced by a just intonation scale, the frequency ratio of the root note tone to the major third note tone is just "4:5", and the frequency ratio of the root note tone to the perfect fifth note tone is "2:3" and accordingly "4:6". On the other hand, when the major triad chord tones are produced with the equally tempered scale, the frequency ratio of the root note to the major third note is "4:5.03984". Thus, the pitch of the major note in the equally tempered scale becomes higher by 14 cents than that of the major third note in the just intonation scale. Furthermore, when major triad chord tones are produced in an equally tempered scale, the frequency ratio of the root note to the perfect fifth note is "4:5.993228". Thus, the pitch of the perfect fifth note in the equally tempered scale is lower by 2 cents than that of the perfect fifth note, in a just intonation scale. As a consequence, where chord tones are produced in a just intonation scale, clear tones can be produced with consonant intervals. On the other hand, were chord tones are produced in an equally tempered scale, the tones become a bit unharmonic.

SUMMARY OF THE INVENTION

Accordingly, it is an object of this invention to provide an electronic musical instrument which can be switched to a just intonation scale from an equally tempered scale only in the case of production of chord tones.

According to this invention, root note of chord tones is detected from a combination of depressed keys in a keyboard. The root tone are generated originally according to equally tempered scale and chord tones other than the root tone are automatically adjusted in frequency so that the frequency ratios between the respective chord tones may become simple (precise) integer values, that is, just intonation scale relationship.

BRIEF DESCRIPTION OF THE DRAWINGS

In the accompanying drawings:

FIG. 1 is a block diagram showing a general construction of one embodiment of the electronic musical instrument according to this invention;

FIGS. 2A, 2B, 2C and 2D are timing charts showing examples of time division time slots of respective tone generating channels and of generation of signals.

DESCRIPTION OF THE PREFERRED EMBODIMENT

Figure 3:
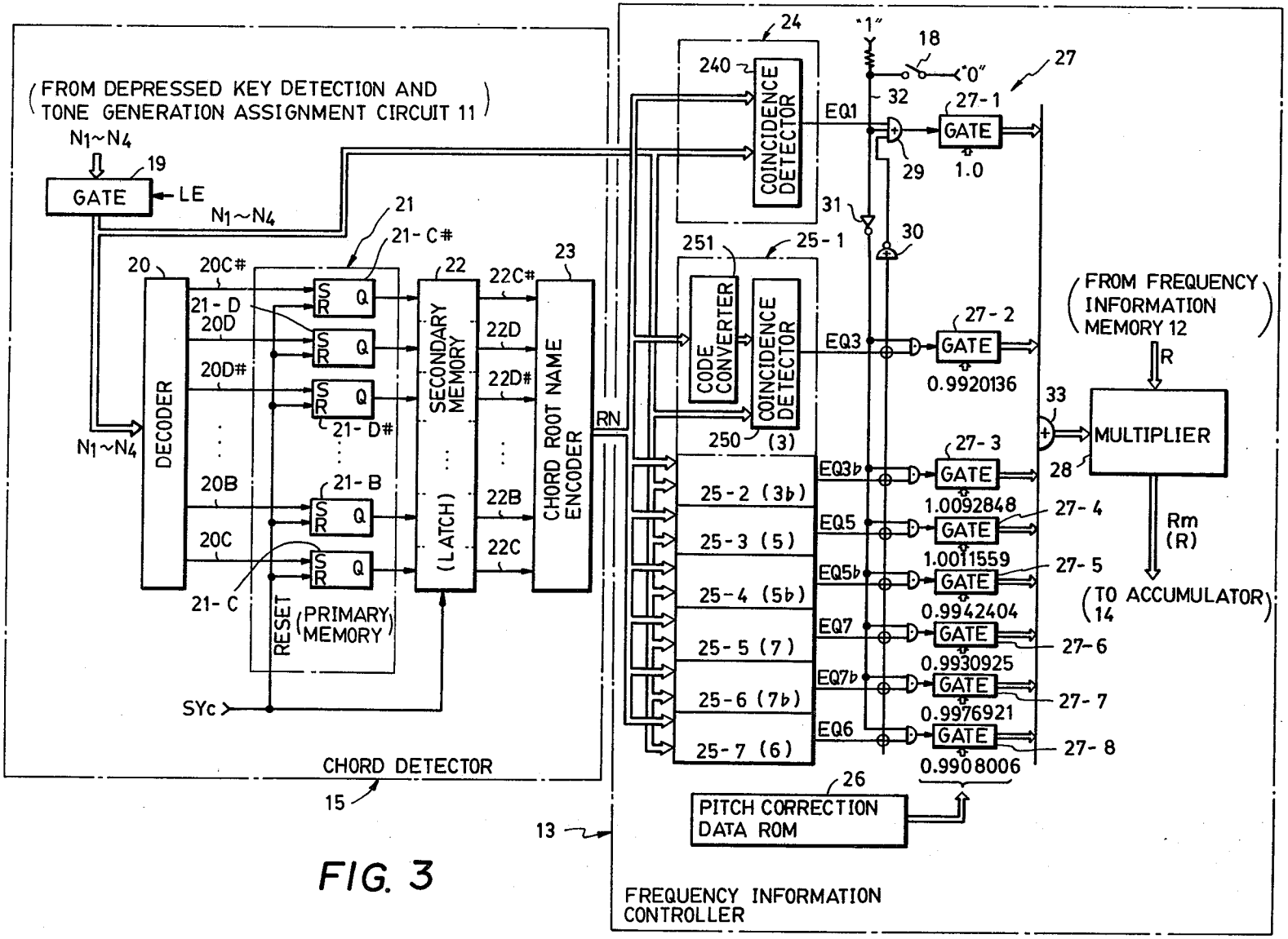
FIG. 3 is a block diagram showing details of the frequency information controller and a chord detector shown in FIG. 1.

In the electronic musical instrument shown in FIG. 1, a keyboard 10 comprises an upper keyboard, a lower keyboard and a pedal keyboard (not shown) and a depressed key detecting and tone generation assigning circuit 11 which operates to detect depressed keys in the keyboard 10 for assigning the tone production as designated by the depressed keys to available tone generating channels. The number of the tone generating channels is 16, for example, and the time slots of the respective channels are formed on a time division basis as shown in FIG. 2A. The width of one time slot corresponds to one period (for example 1 $\mu$s) of a main clock pulse $\phi$. The depressed key detecting and tone generation assigning circuit 11 produces, on a time division basis, key codes assigned to respective channels, key on signals KO representing depressed keys, and other necessary information in synchronism with the given channel time. The circuit 11 also produces, on a time division basis, signals UE, LE, PE representing a keyboard to which the key assigned to the given channel belongs. The depressed key detecting and tone generation assigning circuit 11 of the type described above is disclosed in the specification of U.S. Pat. No. 3,882,751, U.S. Pat. No. 4,114,495, U.S. Pat. No. 4,148,017, U.S. Pat. No. 4,192,211 and U.S. patent applicaton Ser. No. 940,381 filed Sept. 7, 1978 and assigned to the same assignee as the present case.

Each key code KC comprises a note code consisting of four bits: $N_4$, $N_3$, $N_2$ and $N_1$ that discriminate twelve notes within an octave in a musical scale and an octave code consisting usually of three bits (but not specified herein as these are not significant in this invention) that discriminate octaves. One example of the note code $N_1$–$N_4$ is shown in the following Table 1.

TABLE 1

| Note | Bit $N_4$ | $N_3$ | $N_2$ | $N_1$ |
|---|---|---|---|---|
| C# | 0 | 0 | 0 | 1 |
| D | 0 | 0 | 1 | 0 |
| D#0 | 0 | 0 | 1 | 1 |
| E | 0 | 1 | 0 | 1 |
| F | 0 | 1 | 1 | 0 |
| F# | 0 | 1 | 1 | 1 |
| G | 1 | 0 | 0 | 1 |
| G# | 1 | 0 | 1 | 0 |
| A | 1 | 0 | 1 | 1 |
| A# | 1 | 1 | 0 | 1 |
| B | 1 | 1 | 1 | 0 |
| C | 1 | 1 | 1 | 1 |

The key code KC produced by the depressed key detecting and tone generation assigning circuit 11 is applied to a frequency information memory device 12 of a tone generator unit TG. The frequency information memory device 12 prestores frequency informations R, which are values (phase increments per unit time) corresponding to musical tone frequencies of respective keys, the frequencies being determined in an equally tempered scale, so that a frequency information corresponding to an applied key code is read out. These frequency informations are the same as the frequency numbers or frequency informations defined in U.S. Pat. Nos. 3,809,786 and 3,882,751.

A frequency information R produced by the frequency information memory device 12 is applied to an accumulator 14 via a frequency information controller 13. The frequency information controller 13 is used to modify the values of frequency informations R corresponding to subordinate tones respectively of a chord, so that these have predetermined note interval relationships with respect to the root note of the chord. This root note is detected by a chord detector 15. More particularly, it changes the frequency information R of each subordinate tone by such an amount that the interval relationship of each tone constituting the chord becomes of just intonation by taking the root note as the reference.

The accumulator 14 operates to repeatedly add, with a predetermined regular time interval, the frequency informations (R for the root tone and modified values Rn for the subordinate tones) of the tones assigned to the respective channels, thus advancing the phase of each designated musical tone waveform by the repeated additional operations. The output of the accumulator 14 sequentially reads out amplitude values at continuous sampling points of a musical tone waveform which has been stored in a musical tone waveform memory device 16.

A key-on signal KO produced by the depressed key detecting and tone generation assigning circuit 11 is applied to an envelope waveform generator 17 to cause it to produce an envelope waveform signal EV which controls the amplitude envelope of a musical tone waveform signal read out from the musical tone waveform memory device 16. After being suitably controlled in its tone color, tone volume, etc., the musical tone waveform signal produced by the memory device 16 is applied to a sound system SS.

The chord detector 15 is supplied with note codes $N_1$ through $N_4$ among key codes sent out from the depressed key detecting and tone generation assigning circuit 11 for detecting a chord formed by the depressed keys of a predetermined keyboard (for example the lower keyboard) thus producing a signal RN representing the root note of the chord. In accordance with the root note signal, the frequency information controller 13 passes the frequency information R regarding the root note without any modification (that is of the value for the equally tempered scale), whereas it modifies the frequency information R of the notes other than the root note, that is the subordinate notes in a predetermined manner (that is by the amounts to obtain a just intonation scale) in accordance with the respective note intervals of the subordinate notes, so as to produce modified frequency informations Rm. A switch 18 is provided to enable the frequency information controller 13 when desired. Thus, when it is closed the frequency information controller 13 is rendered operative, whereas when it is opened the controller 13 is disenabled to cause it pass all frequency informations R without any modification.

The detail of the frequency information controller 13 and the chord detector 15 will now be described with reference to FIG. 3.

As shown in FIG. 3, the chord detector 15 comprises a gate circuit 19, a decoder 20, a primary memory device 21, a secondary memory device 22 and a chord root name encoder 23. The gate circuit 19 is supplied with only the note code $N_1$–$N_4$ among the key code, on a time division basis, from the depressed key detecting and tone generation assigning circuit 11. A lower keyboard signal LE representing channels to which depressed keys in the lower keyboard are assigned by the depressed key detecting and tone generation assigning circuit 11 is supplied to the control input terminal of the gate circuit 19. Accordingly the gate circuit 19 passes only the note codes regarding the lower keyboard. This is because, in this embodiment, the performance effect of the present invention is applied only to the lower keyboard.

The note code $N_1$–$N_4$ passing through the gate circuit 19 enter the decoder 20 which decodes the note code $N_1$–$N_4$ having contents as shown in Table 1 to produce a signal corresponding to the content of the input note code $N_1$–$N_4$ on either one of twelve output lines 20C#–20C respectively corresponding to twelve notes C# through C. As above described, since the note codes $N_1$–$N_4$ are produced, on a time division basis, in synchronism with respective channel times, output signals are produced on the output lines 20C#–20C of the decoder 20 at different times.

Signals produced by the decoder 20 at different times are temporarily stored in the primary memory device 21, and the signals temporarily stored therein are periodically cleared by the clock pulse $SY_c$ as well as periodically written into the secondary memory device 22. The clock pulse $Sy_c$ is a signal periodically produced in coincidence with the time slot of the first channel as shown in FIG. 2B. More particularly, the primary memory unit 21 comprises 12 parallelly connected set-reset type flip-flop circuits 21-C# through 21-C corresponding to the twelve notes C# through C, the set terminals S of respective flip-flop circuits 21-C# through 21-C being respectively supplied with the signals on the output lines 20C# through 20C. As a consequence, when signals "1" are produced on corresponding decoder output lines 20C# through 20C, the corresponding ones among flip-flop circuits 21C# through 21-C are set. The clock pulse $SY_c$ are commonly applied to the reset input terminals R of respective flip-flop circuits 21-C# through 21-C. As a consequence, while all channel times make one cycle corresponding to the notes of all depressed keys of the flower keyboard, signals stored in respective flip-flop circuits 21-C# through 21-C are all cleared in the subsequent first channel time. However, since the clock pulse generated at the first channel time acts as a load instruction for the secondary memory device 22 the contents of the flip-flop circuits 21-C# through 21-C are transferred and stored in the secondary memory device 22 immediately prior to the resetting of the flip-flop circuits.

The secondary memory device 22 is provided with twelve parallel connected latch circuit elements corresponding to twelve notes C# through C and the output signals of the flip-flop circuits 21-C# through 21-C are applied to respective data inputs of the latch circuit elements, whereas clock pulse Syc is supplied to the load control input of the secondary memory device 22.

The informations of the notes time-divisioned and multiplexed as above described are converted into parallel direct current (continuous) signals for respective tones via the decoder 20, the primary and the secondary memory devices 21 and 22. More particularly twelve outputs on lines 22C# through 22C of the secondary memory device 22 respectively correspond to respective notes C# through C thus producing continuous (or DC) signals "1" on the output lines 22C# through 22C corresponding to the notes of the depressed keys of the lower keyboard. For example, where the keys corresponding to notes C, D and G are simultaneously depressed in the lower keyboard, the outputs 22C, 22D and 22G are all "1".

The outputs 22C# through 22C from the secondary memory device 22 are applied to a chord root name encoder 23 which detects a chord in accordance with a state of combination of twelve input signals (outputs 22C#–22C) from the secondary memory device 22 and corresponding to the notes C# through C respectively, thus producing a signal RN representing the name of the root note of that chord. The root note signal RN is a 4-bit data having the same encoded content as the note code $N_1$–$N_4$ shown in Table 1. Combinations of notes constituting respective chords are prestored in the chord root name encoder 23 so that a predetermined root note signal RN is read out from the chord root name encoder 23 in accordance with a combination of notes applied thereto.

The root note signal RN read out from the chord root name encoder 23 is sent to the frequency information controller 13. Also the note code $N_1$–$N_4$ of the tones of the lower keyboard passing through the gate circuit 19 in the chord detector 15 are applied to the frequency information controller 13.

The frequency information controller 13 comprises a root note assigning channel detector 24, subordinate note assigning channel detectors 25-1 through 21-7, a pitch correction data ROM 26, a pitch correction data selection gate circuit 27, and a multiplier 28. The root note assigning channel detector 24 operates to detect a channel which is assigned with a depressed key of the lower keyboard having the detected root note name, and comprises a coincidence detection circuit 240. The subordinate note assigning channel detectors 25-1 through 25-7 operates to detect channel which are assigned with depressed keys of the lower keyboard corresponding to the respective subordinates notes or intervals and are constituted by a coincidence detection circuit 250 and a code converting circuit 251.

Although the internal construction of only one subordinate note assigning channel detector 25-1 is shown, other detectors 25-2 through 25-7 also have the same construction. However, the contents of conversion of the code converter 251 of each of the detectors 25-1 through 25-7 are different from each other.

The root note signal RN read out from the chord root name encoder 23 is applied to one input of the coincidence detector 240 of the root note assigning channel detector 24 and to the code converters 251 of each one of the subordinate tone assigning channel detectors 25-1 through 25-7. The output of the code converter 251 is applied to one input of the coincidence detector 250. To the other inputs of the coincidence detectors 240 and 250 of the detectors 24, 25-1 through 25-7 are applied, on the time division basis, the note code $N_1$ through $N_4$ of the depressed keys of the lower keyboard selected by the gate circuit 19.

The coincidence detector 240 of the root note assigning channel detector 24 compares the root note represented by the root note signal RN with a note in the lower keyboard assigned to each channel. When a coincidence is obtained, the detector 240 produces a coincidence detection signal EQ1. Thus, the coincidence detection signal EQ1 becomes "1" in synchronism with a time divided time slot of a channel assigned to a key corresponding to the root note of the chord of keys of the keyboard now being depressed. In this manner, a root note assigning channel is detected.

The subordinate note assigning channel detector 25-1 corresponds to the subordinate note of a major third musical interval (3) from the root note and its code converter 251 converts the note code ($N_1$–$N_4$) of the root note signal RN into a note code having a note name of a major third interval above the root note.

The relationship among the input and the output codes of the code converter 251 for the major third is shown by the following Table 2.

TABLE 2

| input RN | C | C# | D | D# | E | F | F# | G | G# | A | A# | B |
|---|---|---|---|---|---|---|---|---|---|---|---|---|
| output code | E | F | F# | G | G# | A | A# | B | C | C# | D | D# |

Consequently, to one input of the coincidence detector 250 of the subordinate note assigning channel detector 25-1 is supplied a note code (major third subordinate note) having a pitch of the major third from the code converter 251. Accordingly, the coincidence detector 250 of the major third interval detector 25-1 produces a coincidence detection signal EQ3 in synchronism with the time slot of the channel assigned to the depressed key of the lower keyboard which has a major third interval with respect to the root note signal RN. Of course, when a key corresponding to the major third degree is not depressed, the coincidence detection signal EQ3 is not produced at any time slots.

The subordinate not assigning channel detector 25-2 corresponds to the chord constituent of the minor third interval (3♭) and a code converter, not shown, contained therein converts the note code of the root note signal RN into a note code having a minor third interval which respect to the note code of the signal RN. In the same manner as above described a coincidence detection signal EQ3♭ is generated in synchronism with the time slot of the channel to which the depressed key of the lower keyboard having a minor third interval with respect to the root note is assigned. In the same manner, the subordinate note assigning channel detector 25-3 corresponds to a perfect fifth interval (5), the detector 25-4 to the diminished fifth interval (5♭), the detector 25-5 to the major seventh interval, detector 25-6 to the minor seventh interval (7♭) and the detector 25-7 to the major sixth interval (6) respectively, and the code converters, not shown, contained therein are constructed to convert the note code of the root note signal RN into note code respectiely having predetermined note interval relationships. Coincidence signals EQ5, EQ5♭, EQ7, EQ7♭ and EQ6 are respectively produced in synchronism with the time slots of the channels to which the respective chord constituents corresponding to the respective note intervals (5, 5♭, 7, 7♭ and 6) are assigned.

The coincidence detection signals EQ1, EQ3, EQ3♭, Q5, EQ5♭, EQ7, EQ7♭, and EQ6 are applied to a pitch correction data selection gate unit 27 for selecting pitch correction data responding to respective note intervals from a pitch correction data ROM 26. The pitch correction data selection gate unit 27 comprises eight gate circuits 27-1 through 27-8 corresponding to the root note and other chord constituents. The pitch correction data are supplied from the pitch correction data ROM 26 to the data input terminals of respective gate circuits 27-1 through 27-8.

The coincidence detection signal EQ1 produced by the root note assigning channel detector 24 is applied to the gate control input of the gate circuit 27-1 corresponding to the root note via an OR gate circuit 29. The gate circuit 27-1 is opened when a signal applied to the gate control input from the OR gate circuit 29 is "1" to produce the pitch correction data given by the pitch correction data ROM 26 as its output. To the other inputs of the OR gate circuit 29 are applied the output of the switch 18 and the output of a NOR gate circuit 30, which is supplied with the coincidence detection signals EQ3 through EQ6 produced by the subordinate note assigning channel detectors 25-1 through 25-7.

The gate control input terminals of the gate circuits 27-2 through 27-8 corresponding to the subordinate notes of respective note intervals (3, 3♭, 5, 5♭, 7, 7♭ and 6) are respectively supplied with the coincidence detection signals EQ3, EQ3♭, EQ5, EQ5♭, EQ7, EQ7♭ and EQ6, and the output of the switch 18. Only when all of the coincidence detection signals (EQ3 through EQ6) and the inverted output of the switch 18 are "1", the gate circuits 27-2 through 27-8 are opened to pass the pitch correction data from the pitch correction data ROM 26. When switch 18 is closed, the signal on its output line 32 becomes "0" whereas the output of the inverter 31 becomes "1" thereby satisfying one condition of the gate control inputs of the gate circuits 27-2 through 27-8. Under these conditions when a coincidence detection signal (one of EQ3 through EQ6) is produced, a gate circuit (one of 27-2 through 27-8) corresponding to the coincidence detection signal thus produced is enabled. To manifest the performance effect of this invention, it is necessary to close the switch 18.

The pitch correction data ROM 26 prestores pitch correction data for respective subordinate notes which are necessary to make the note interval relationship between respective subordinate notes and the root note to be of just intonation scale, and applies the pitch correction data for the root note and the respective subordinate notes to the corresponding gate circuits 27-1 through 27-8 respectively. These pitch correction data are used to correct the note interval relationship based on a equally tempered scale to that based on a just intonation scale. The value of the pitch correction data produced by the pitch correction data ROM 26 for the respective note degrees (intervals above the root note) and the cent differences between the equally tempered scale notes and the just intonation scale notes are shown in the following Table 3.

TABLE 3

| note degree | pitch correction data from ROM 26 | cent diff. between equally tempered scale and just intonation scale |
|---|---|---|
| unison | 1.0000000 | 0(cent) |
| major third | 0.9920136 | −14 |
| minor third | 1.0092848 | +16 |
| perfect fifth | 1.0011557 | +2 |
| diminished fifth | 0.9942404 | −10 |
| major seventh | 0.9930925 | −12 |
| minor seventh | 0.9976921 | −4 |
| major sixth | 0.9908006 | −16 |

Table 3 shows that the note of the major third degree can be produced in accordance with the just intonation scale relationship in case that the frequency of the tone in accordance with the equally tempered scale is corrected to a frequency 14 cent lower than the frequency of the tone in accordance with the equally tempered scale. Pitch correction data are expressed by the frequency ratio of the modified frequency to not corrected frequency (or no frequency change). Thus, the pitch correction data (that is a frequency ratio) determined by the following equation which represents the relationship between the frequency ratio Fr and the cent value $$Fr = 2^{\frac{c}{1200}}$$

are calculated in accordance with the cent differences at respective note intervals and the calculated data are stored in the pitch correction data ROM 26 in terms of binary numerals.

The pitch correction data selected by the gate circuits 27-1 through 27-8 are applied to a multiplying input of a multiplier 26 through an OR logic gate circuit 33. To the multiplicand input of the multiplier 28 is applied a frequency information R read out from the frequency information memory device 12. As above described, since the pitch correction data are represented by the frequency ratio between the frequency not modified (or the frequency in accordance with the equally tempered scale) and the modified frequency (or the frequency in accordance with the just intonation scale), the modified frequency information Rm in accordance with the just intonation scale can be produced as a product obtained by multiplying the frequency inforation R in accordance with the equally tempered scale by the pitch correction data in the multiplier 28.

The operation of the electronic musical instrument will be described hereunder by taking a case as an example in which three keys C, E and G of the lower keyboard are depressed.

As shown in FIG. 2C, where tones of keys C, E and G are assigned to the second, fourth and sixth channels, respectively, a lower keyboard signal LE would be produced as shown in FIG. 2D. Consequently, the gate circuit 19 is enabled only at the time slots of the second, fourth and sixth channels to select the note code $N_1$–$N_4$ of the keys C, E and G at the time slots of respective channels. "1" is respectively stored in the three latch circuit elements corresponding to keys C, E and G of the secondary memory device 22 of the chord detector 15, whereby outputs 22C, 22E and 22G are continuously maintained at "1". Based on the combination of notes C, E and G, a chord root name encoder detects that the chord is a C major chord so and produces a root note signal RN having a content "1 1 1 1" which represents note C is produced.

In the coincidence detection circuit 240 of the root note assigning channel detector 24, two input codes coincide with each other at the time slot of the second channel to which the C note of the lower keyboard is assigned thus producing a coincidence detection signal EQ1 which is applied to the gate circuit 27-1 via the OR gate circuit 29, thus selecting a pitch correction data [1] produced by the pitch correction data ROM 26 and relating to the root note by the gate circuit 27-1. The pitch correction data [1] is supplied to the multiplier 28 at the second time slot of the second time channel and multiplied by the frequency information R of note C which is assigned to the second channel and applied to the multiplier at the same time. However, in the case of the root note, since the pitch correction data is [1], the frequency information R would not be changed by the multiplying operation. Accordingly, the root tone is generated with the pitch of the equally tempered scale.

The code converter 251 of the subordinate note assigning channel detector 25-1 corresponding to the major third interval converts the note code "1 1 1 1" of the root note signal PN into an E note code "0 1 0 1" of third interval with respect to the root note. Consequently, in the coincidence detector 250 in the detector 25-1 the two inputs coincide with each other at the time slot of the fourth channel to which the E note is assigned to produce a coincidence detection signal EQ3 which is used to select through the gate circuit 27-2 a pitch correction data [0.9920136] corresponding to the major third degree at the time slot of the fourth channel. At the same time the coincidence detection signal EQ3 is multiplied with the frequency information of the E note assigned to the fourth channel and is supplied to the multiplier 28 at the same time. Accordingly, the E note is produced at a frequency that satisfies the just intonation scale (that is a frequency 14 cents lower than that of the same note in the equally tempered scale.

The frequency ratio of the note of the major third degree to the root note is 2 4/12 in the equally tempered scale. If this frequency ratio is multiplied with the pitch correction data [0.9920136], a product [about 1.249858] is obtained. And if this product is multiplied with 4, then a value 5 would be obtained, with an error less than 1 cent being neglected. Accordingly, the frequency ratio of the root note to the major third degree note thus produced by the modified frequency information would become 4:5 which is a simple integer ratio thereby providing the just intonation scale relationship.

The code converter (corresponding to converter 251) of the subordinate note assigning channel detector 25-3 corresponding to the perfect fifth degree converts the code "1 1 1 1" of the root note signal RN into the code "1 0 0 1" to indicate the G note which is the fifth degree note with respect to the root note C. Accordingly, the detector 25-3 produces a coincidence signal EQ5 at the time slot of the sixth channel assigned to the G note of the lower keyboard for supplying to the multiplier 25 a pitch correction data 1.0011559 corresponding to the perfect fifth interval. This data is multiplied with the frequency information R of the G note assigned to the same sixth channel. Accordingly, the G note is produced at a frequency that satisfies the just intonation scale relationship, that is at a frequency 2 cents higher than that of the same note in the equally tempered scale.

The frequency ratio of the note of the perfect fifth interval above the root is 2 7/12 in the equally tempered scale. If this ratio is multiplied with the pitch correction data 1.0011559, the product becomes about 1.500038. And if this product is multiplied with 4 and by neglecting an error less than 1 cent, the result would be 6. Thus, the ratio of the root note to the perfect fifth degree note produced by the modified frequency information Rm becomes 4:6 which is a simple integer ratio thereby providing the just intonation scale relationship.

As above described, a chord of C,E ang G are produced under a just intonation scale relationship. Although not specifically described, with regard to another note intervals, (3♭, 5♭, 7, 7♭ and 6), pitch correction data are set as shown in Table 3 so as to satisfy the just intonation scale relationship.

In the case of lower keyboard notes having degrees other than major third, minor third, perfect fifth, diminished fifth, major seventh, minor seventh major sixth and in the case in which it is impossible to generate a root note signal due to impossibility of detecting a chord, and at the time slots of the channels to which tones of keyboard other than the lower keyboard are assigned, no coincidence detection signal is produced by the detectors 25-1 through 25-7. In this case, the output of the NOR gate circuit 30 becomes "1" so as to enable the gate circuit 27-1 via OR gate circuit 29 thereby selecting a pitch correction data [1] corresponding to the first degree (unison). Thus, the frequency information is not changed at all and the musical tones are generated according to the equally tempered scale.

When switch 18 is opened, a signal "1" is normally applied to the output line 32 so that the gate circuit 27-1 is normally opened via OR gate circuit 29. At the same time, the output of the inverter 31 becomes "0" thus disenabling the gate circuits 27-2 through 27-8. Consequently, a signal [1] is always applied to one input of the multiplier 28 so that the frequency information R would not be changed thereby producing musical tones according to the equally tempered scale.

While in the frequency information controller 13 shown in the foregoing embodiment, the pitch correction data ROM 26 constantly produces pitch correction data which are supplied to the pitch correction data selection gate unit 27 to select a predetermined pitch correction data in accordance with the coincidence detection signals EQ1 through EQ6 and a signal on a line 32 and then to supply the selected data to the multiplier 38, it is also possible to directly address the pitch correction data ROM 26 with the coincidence detection signal EQ1 throuth EQ6 and with the signal on the line 32 so as to read out a predetermined pitch correction data (Table 3) depending upon the state of these address signals and to apply the read out data to the multiplier 28.

What is claimed is:

1. An electronic musical instrument comprising:

keybord keys;

first means, cooperatively connected to said keyboard, for providing musical tones corresponding to depressed keys and having frequencies of an equally tempered scale;

second means, cooperatively connected to said keyboard, for detecting a chord according to a combination of depressed ones of said keys; and third means, connected to said first means and to said second means for automatically causing said first means to modify the frequencies of chord constituent tones other than root note tones of the chord in respective amounts that bring the frequencies of said modified chord constituent tones to just intonation relationship with said root note tone.

2. An electronic musical instrument according to claim 1 wherein;

said second means detects a chord name according to the combination of the depressed keys, and includes encoder circuitry to produce a root note signal representing the root note of said detected chord; and wherein;

said third means comprises:

a note interval detecting circuit, connected to said second means, for detecting note intervals of the respective depressed keys with respect to the root note; and a pitch adjusting circuit, connected to said first means and to said note interval detecting circuit, for respectively correcting the frequencies of tones for depressed keys other than said root note in accordance with individual note intervals of said depressed other keys as detected by said note interval detecting circuit.

3. An electronic musical instrument according to claim 2 wherein said first means comprises;

a waveform memory device, a frequency information memory storing frequency information for tones in an equally tempered scale and providing frequency information for tones corresponding to the depressed keys, an accumulator accumulating the frequency information provided by said frequency information memory, and means for reading out said waveform memory device in accordance with a result of accumulation of said accumulator, and wherein;

said pitch adjusting circuit comprises:

a circuit for producing pitch correction values corresponding to individual note intervals detected by said note interval detecting circuit, and a multiplier which individually multiplies said provided frequency information for tones corresponding to respective depressed keys by said pitch correction values for the note intervals of the respective depressed keys.

4. An electronic musical instrument according to claim 1 wherein:

said second means detects a chord name according to the combination of the depressed keys thereby to produce a root note signal representing the root note of said detected chord, and wherein said third means comprises:

a note interval detecting circuit, connected to said second means, for detecting note intervals of the respective depressed keys with respect to the root note, and a pitch adjusting circuit, connected to said first and second means, for respectively modifying the frequencies of tones for the depressed keys other than said root note to be of just intonation pitch with respect to said root note, in accordance with individual note intervals detected by said note interval detecting circuit.

5. An electronic musical instrument providing chord tones in a selected scaler relationship, said instrument having a polyphonic tone generator in which musical tones are generated at frequencies established by respective supplied frequency information numbers associated with selected notes, and in which said supplied frequency information numbers normally result in the generation of musical tones having a scaler relationship which is different from said selected scaler relationship, comprising:

chord detector means for detecting that the selected notes constitute a chord and for providing an encoded signal indicative of the root note name of said chord, and frequency information controller means, cooperatively connected to said chord detector means and to said tone generator, for modifying the supplied frequency information number for each selected note which is a constituent of a detected chord by a pitch correction factor related to the note degree in the detected chord of that selected note.

6. An electronic musical instrument according to claim 5 wherein said tone generator normally generates tones in the equally tempered scale, and wherein the modified frequency information numbers result in the generation of musical tones in the just intonation scale.

7. An electronic musical instrument according to claim 5 wherein the selected notes are represented by note codes supplied repetitively in time shared fashion to said tone generator, and wherein said frequency information controller means comprises:

a first coincidence detector for comparing each supplied note code with said encoded signal indicative of the root note name and for providing a "unison" output signal when an equal comparison occurs, a set of subordinate note detectors, each receiving said supplied note codes and said encoded signal indicative of the root note name, for determining if the selected note corresponding to a supplied note code has a certain interval relationship with said indicated root note name, and for providing as an output a signal indicative of said interval relationship, a pitch correction data source providing said pitch correction factors, pitch correction data selection means, cooperatively connected to said pitch correction data source, to said first coincidence detector and to said set of subordinate note detectors, for providing the appropriate pitch correction factor in accordance with the interval relationship indicated by said "unison" output signal or said interval relationship indicating signal, and means for modifying said supplied frequency information numbers by said provided appropriate pitch correction factors.

* * * * *